US008833282B2

(12) United States Patent
Yoshida

(10) Patent No.: US 8,833,282 B2
(45) Date of Patent: Sep. 16, 2014

(54) SEWING MACHINE

(71) Applicant: Tokai Kogyo Mishin Kabushiki Kaisha, Kasugai (JP)

(72) Inventor: Takahiro Yoshida, Nagoya (JP)

(73) Assignee: Tokai Kogyo Mishin Kabushiki Kaisha, Kasugai-shi (JP)

( * ) Notice: Subject to any disclaimer, the term of this patent is extended or adjusted under 35 U.S.C. 154(b) by 10 days.

(21) Appl. No.: 13/889,783

(22) Filed: May 8, 2013

(65) Prior Publication Data

US 2013/0298812 A1 Nov. 14, 2013

(30) Foreign Application Priority Data

May 8, 2012 (JP) ..... 2012-107072

(51) Int. Cl.
*D05B 49/00* (2006.01)
*D05B 77/00* (2006.01)

(52) U.S. Cl.
CPC ..... *D05B 49/00* (2013.01)
USPC ..... 112/241

(58) Field of Classification Search
USPC ..... 112/225, 241–247
See application file for complete search history.

(56) References Cited

U.S. PATENT DOCUMENTS 3,782,312 A * 1/1974 Kasuga ..... 112/241
4,030,431 A * 6/1977 Martin et al. ..... 112/241
4,651,660 A * 3/1987 Oshima et al. ..... 112/225
4,736,698 A * 4/1988 Inagaki ..... 112/247
4,776,292 A * 10/1988 Rodda et al. ..... 112/241
5,655,471 A * 8/1997 Tajima ..... 112/261
6,247,419 B1 * 6/2001 Tajima et al. ..... 112/98
6,382,119 B2 * 5/2002 Tajima et al. ..... 112/241

FOREIGN PATENT DOCUMENTS

CN 102140742 A 8/2011

OTHER PUBLICATIONS

Notice of Grounds for Rejection (Office Action) regarding corresponding Japanese Patent Application No. P2012-107072, dated Feb. 25, 2014.

* cited by examiner

*Primary Examiner* — Ismael Izaguirre
(74) *Attorney, Agent, or Firm* — Wong, Cabello, Lutsch, Rutherford & Brucculeri, LLP.

(57) ABSTRACT

Sewing machine includes, in association with each thread take-up levers: a thread take-up member provided on the front surface of a support member cover and having a thread take-up spring; a prevention member for preventing a thread, put on the thread take-up spring, from flowing rearward; a cover member provided in front of the thread take-up member and independently detachable in a forward direction; and a guide section having a valley portion formed therein for receiving therein a distal end portion of the thread take-up spring and movably guiding the received distal end portion. The cover member has a lower end portion opened to permit insertion therein of a thread and is constructed to guide the thread from the lower end portion to the thread take-up spring. The cover member may further include a guide wall for guiding the thread from the lower end portion to the thread take-up spring.

15 Claims, 5 Drawing Sheets

SEWING MACHINE

CROSS REFERENCE TO RELATED APPLICATION

This application is based on, and claims priority to, Japanese Patent Application Number 2012-107072 filed on 8 May 2012. The disclosure of the priority application, in its entirety, including the drawings, claims, and the specification thereof, are incorporated herein by reference.

BACKGROUND

The present invention relates to sewing machines which include a thread take-up lever and a thread take-up member disposed on a portion of an upper thread path immediately upstream of the thread take-up lever, and more particularly to a sewing machine improved to facilitate setting of an upper thread onto a thread take-up member disposed upstream of a thread take-up lever.

Chinese Patent Application Publication No. CN102140742 (hereinafter referred to as "the relevant patent literature") discloses a multi-needle embroidery sewing machine which includes a thread take-up member disposed on a portion of an upper thread path immediately upstream of a thread take-up lever and which facilitates setting of an upper thread onto the thread take-up member. The embroidery sewing machine disclosed in the relevant patent literature includes a thread take-up lever cover integrally covering a plurality of thread take-up levers in a predetermined range of a vertical (or up-down) pivoting path of the thread take-up levers. The thread take-up lever cover comprises a bottom plate and a forwardly-bulging panel, and slits are formed in the forwardly-bulging panel in corresponding relation to the thread take-up levers. An upper portion and lower portion of each of the slits each have an increased width, and a distal end portion of the thread take-up lever is inserted in the upper portion of the slit while a later-described holding plate cover is inserted in the lower portion of the slit. A fixing plate is fixed in the interior of the thread take-up lever cover by being inserted from the back side of the thread take-up lever cover, and thread take-up members are provided on the fixing plate in corresponding relation to the thread take-up levers. Each of the thread take-up members includes a holding plate fixed to the front surface of the fixing plate, the holding plate cover fixed to the front end of the holding plate, and each of the holding plate covers is inserted in the lower portion of the corresponding slit and has a lower end portion projecting forward beyond the panel. A thread tension device is provided on one side surface of the holding plate. The thread tension device includes a disk and a pin, the disk is mounted to the holding plate via the pin, and the disk has a plurality of holes formed in the disk along a same imaginary circle of the disk. The thread tension device includes a thread take-up spring that has a coiled spring section fitted over the pin and a forwardly-projecting thread take-up hook section of a triangular shape. The proximal end of the coiled spring section of the thread take-up spring is inserted in any one of the plurality of holes formed in the disk. Further, the holding plate has a recessed groove of an arcuate shape corresponding to a movement trajectory of the thread take-up hook section of the thread take-up spring, and the thread take-up hook section is positioned in the recessed groove.

When a thread is to be set onto the thread take-up member and the thread take-up lever in the embroidery sewing machine disclosed in the relevant patent literature, the thread is passed through the corresponding slit formed in the panel, then directed from the right side of the holding plate cover to and across the lower side, located in front of the panel, of the holding plate cover, then turned back and then pulled upward. Thus, the thread is directed along the recessed groove of the holding plate into the triangular thread take-up hook section of the thread take-up spring. Then, the thread is passed through the thread take-up lever, turned back downward, then passed through the slit and directed along the left side of the holding plate cover to a sewing needle. Thus, according to the embroidery sewing machine disclosed in the relevant patent literature, setting of a thread onto the thread take-up member can be performed with ease. Besides, because of the arrangements that the disk of the thread take-up device has the plurality of holes formed along the same imaginary circle of the disk and the proximal end of the coiled spring section of the thread take-up spring is insertable in any one of the plurality of holes, spring resilience of the thread take-up spring is adjustable by changing the hole where the proximal end of the coiled spring section is inserted to another one of the holes. In this way, spring resilience suited for any desired threads to be used can be obtained.

When maintenance is to be performed on the thread take-up lever in the embroidery sewing machine disclosed in the relevant patent literature, it is necessary to dismount or detach, from the machine head, the thread take-up lever cover having the thread take-up member fixed thereto and then detach, from the back surface side of the thread take-up lever cover, the fixing plate having the thread take-up member fixed thereto. Thus, in order to detach the thread take-up lever cover, all threads set on the sewing machine have to be removed. Thus, when the thread take-up lever cover is mounted or attached again, all of the threads have to be set again. For these reasons, operations involved in the maintenance tend to be very bothersome and time-consuming.

Further, when the hole of the disk in which the proximal end of the coiled spring section of the thread take-up spring is inserted is to be changed to another one of the holes, it is necessary to further detach the holding plate from the fixing plate and detach the disk from the holding plate. This is because, with the holding plate left fixed to the fixing plate, the disk cannot be detached due to interference between the holding plate and other holding plates adjoining that holding plate. Thus, the operation for changing the spring resilience too tends to be very bothersome and time-consuming. Namely, with the embroidery sewing machine disclosed in the relevant patent literature, the operations involved in the maintenance have been very laborious and time-consuming.

SUMMARY OF THE INVENTION

In view of the foregoing prior art problems, it is an object of the present invention to provide an improved sewing machine which not only allows an upper thread to be set onto a thread take-up member but also allows operations involved in maintenance to be performed with ease.

Note that the same reference numerals and characters as used for various constituent elements of later-described embodiments of the present invention are indicated in parentheses in the summary below for ease of understanding but are never intended to limit the scope of the invention.

In order to accomplish the above-mentioned object, the present invention provides an improved sewing machine comprising: a support member (2); one or more needle bars each vertically movably supported by the support member (2) and having a sewing needle (5) attached to a lower end thereof; one or more thread take-up levers (6) vertically pivotably supported by the support member (2) in association with individual ones of the needle bars; a support member cover (7) disposed on a front surface of the support member (2) and constructed to permit insertion therethrough of the one or more thread take-up levers (6), the sewing machine further comprising, in association with each of the thread take-up levers (6): a thread take-up member (10; 30) disposed on the front surface of the support member cover (7; 31) and having a thread take-up spring (15; 37); a prevention member (19) for preventing a thread, put on the thread take-up spring (15; 37), from flowing rearward; a cover member (8; 40) provided in front of the thread take-up member (10; 30) in such a manner that the cover member (8; 40) is independently detachable in a forward direction, the cover member (8; 40) having a lower end portion (8*b*) opened to permit insertion therein of a thread, the cover member (8; 40) being constructed to guide the thread from the lower end portion (8*b*) to the thread take-up spring (15; 37); and a guide section (8*c*, 33*c*) having a valley portion (8*d*) formed therein for receiving therein a distal end portion of the thread take-up spring (15; 37) and movably guiding the received distal end portion.

When a thread is to be set onto the thread take-up spring (15; 37), the thread is hooked across the lower end portion (8*b*) of the cover member (8; 40) from a lateral side of the cover member (8; 40), turned back and then pulled upward. Thus, the thread is inserted through an open space of the lower end portion (8*b*) of the cover member (8; 40), guided along the cover member (8; 40) and then set onto the thread take-up spring (15; 37). In this way, the present invention allows the thread to be set onto the thread take-up spring (15; 37) with ease. Although the thread thus set on the thread take-up spring (15; 37) may slack during a sewing operation, such as embroidery sewing, it can be prevented from coming off the thread take-up spring (15; 37), because the distal end portion of the thread take-up spring (15; 37) is received in the valley portion (8*d*) formed in the guide section (8*c*; 33*c*). Further, because the prevention member (19) prevents the thread from flowing rearward, the thread can be prevented from flowing rearward to get caught by any of other component parts. Further, each of the cover members (8; 40) is provided in association with any one of the thread take-up levers (6) independently of the other cover members (8; 40) and thus independently detachable in the forward direction of the machine. Thus, when maintenance is to be performed on the thread take-up member (10; 30) corresponding to the one thread take-up lever (6), it is only necessary to detach the corresponding cover member (8; 40) in the forward direction without the thread set on the thread take-up spring (15; 37) being removed. In this way, operation involved in the maintenance of the thread take-up member (10; 30) can be highly facilitated.

In an embodiment, the cover member (8) further has a guide wall (8*c*) adapted to guide the thread from the lower end portion (8*b*) to the thread take-up spring (15). Further, in an embodiment, the guide section (8*c*) having the valley portion (8*d*) formed therein is provided on the cover member (8). In another embodiment, the guide section (33*c*) having the valley portion formed therein is provided on the thread take-up member (30). In an embodiment, the guide section (33*c*) having the valley portion formed therein is formed of a different material from the cover member (40). Further, in an embodiment, the guide section (8*c*; 33*c*) further has an outline adapted to guide a thread from the lower end portion of the cover member to the thread take-up spring (15; 37).

Furthermore, in an embodiment, the cover member (8; 40) includes a thread take-up lever cover section (8*g*) covering a distal end portion of the thread take-up lever in a predetermined range of a vertical pivoting path of the thread take-up lever. Thus, with a simple construction, the present invention can prevent a human operator from accidentally or carelessly touching the thread take-up lever and prevent an eternal object etc. from hitting the thread take-up lever.

Furthermore, in an embodiment, the thread take-up spring (15; 37) includes: a coil section (15*a*) formed of a spring wire wound in a coil shape; a lever section (15*b*) formed integrally with and extending continuously from one end of the coil section in a radial outward direction; a thread-engaging hook section (15*c*) formed integrally with a distal end of the lever section; and a locking section (15*d*) formed integrally with another end of the coil section. The thread take-up member (10; 30) includes a holding member (12; 33) having a mounting hole (12*a*; 33*b*); a cylindrical case (13; 35) fixed to the mounting hole (12*a*; 33*b*) of the holding member (12; 33), and a spring shaft (16; 38) rotatably fitted within the cylindrical case (13; 35), the spring shaft (16; 38) having an engaging groove (16*c*) for engagement with the locking section (15*d*) of the thread take-up spring (15; 37). The thread take-up spring (15; 37) is mounted on the spring shaft (16; 38) by the locking section (15*d*) of the thread take-up spring being engaged with the engaging groove (16*c*) with the coil section (15*a*) of the thread take-up spring (15; 37) mounted around an outer periphery of the spring shaft (16; 38). The cylindrical case (13; 35) has a recess (13*b*) formed therein by being recessed over a predetermined angular range thereof, the spring shaft (16; 38) being fixed to the cylindrical case (13; 35) via a fastening member (17) with the lever section (15*b*) of the thread take-up spring (15; 37) positioned in the recess (13*b*) and abutted against a lower end of the recess (13*b*).

Namely, the spring shaft (16; 38) is rotatably fitted within the cylindrical case (13; 35), and the locking section (15*d*) of the thread take-up spring (15; 37) engages with the engaging groove (16*c*). By canceling the fixation, by the fastening member (17), of the spring shaft (16; 38) and rotating the spring shaft (16; 38) about its axis, the present invention can change the spring resilience of the thread take-up spring (15; 37). Thus, the spring resilience of the thread take-up spring (15; 37) can be readily changed without component parts being removed from the holding member (12; 33).

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

Figure 1:
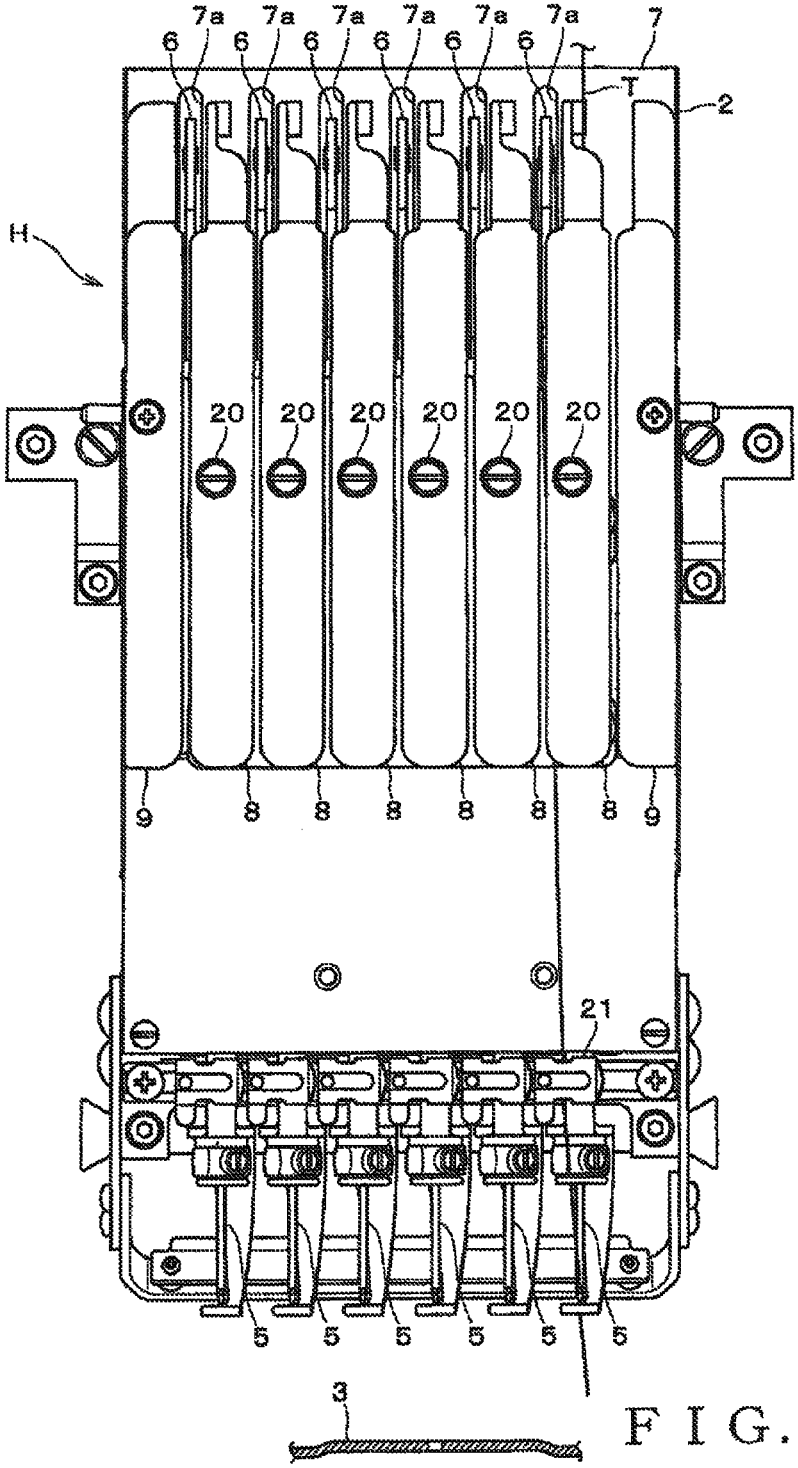
FIG. 1 is a front view showing a multi-needle machine head in an embroidery sewing machine according to an embodiment of the present invention.
Figure 2:
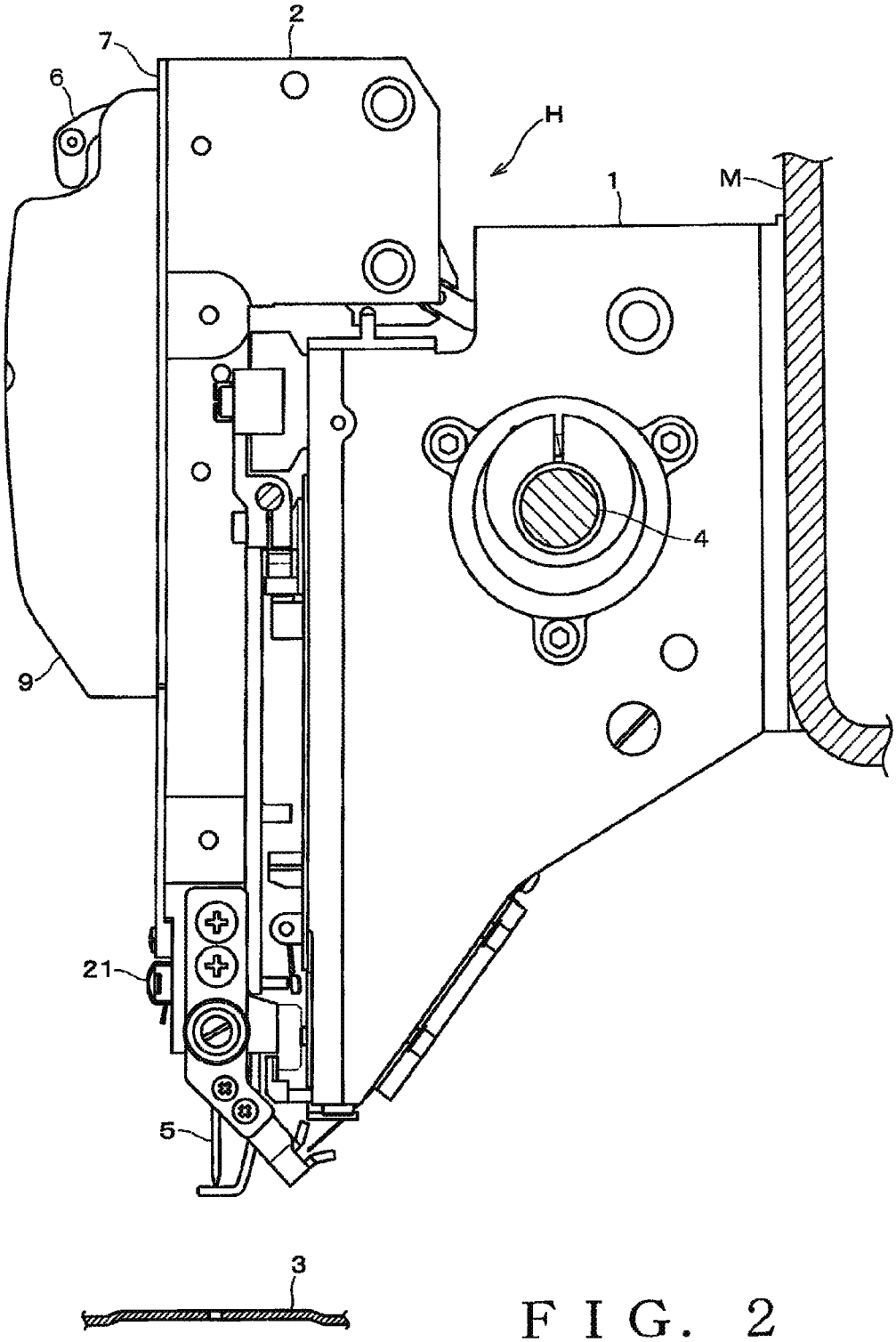
FIG. 2 is a right side view of the machine head shown in FIG. 1.

FIG. 1 is a front view showing a multi-needle machine head H in an embroidery sewing machine according to an embodiment (first embodiment) of the present invention, and FIG. 2 is a right side view of the machine head H. The machine head H includes an arm 1 fixed to a machine frame M, and a needle bar case (support member) 2 supported on the front surface of the arm 1 for horizontal sliding movement therealong. A needle plate 3 is provided under the machine head H, and a not-shown rotationally-driven rotary hook of a well-known construction is provided beneath the needle plate 3. A main machine shaft 4 rotationally driven by a not-shown machine driving motor extends through the arm 1. As conventionally known, a plurality of (e.g., six) needle bars (not shown), each having a sewing needle 5 fixed thereto, are supported by the needle bar case (support member) 2 for vertical (up-down) movement. Further, thread take-up levers 6 corresponding to the needle bars are supported by the needle bar case (support member) 2 for vertical (up-down) pivoting movement, and each of the thread take-up levers 6 has a distal end portion projecting forward through a corresponding one of vertical slits 7*a* formed in a front cover plate (support member cover) 7 fixed to the front surface of the needle bar case 2. As conventionally known, the needle bar case 2 is slidable horizontally, by means of a not shown color change mechanism, so that one needle bar (and hence one thread color) to be used for a sewing operation can be selected from among the plurality of needle bars. As also conventionally known, in response to rotation of the main machine shaft 4 and via not-shown drive mechanisms, not only the selected needle bar (sewing needle 5) moves vertically (in the up-down direction), but also the thread take-up lever 6 corresponding to the selected needle bar moves vertically. Sewing is performed in the conventionally-known manner by cooperation between the vertical movement of the sewing needle and the rotary hook.

Figure 3:
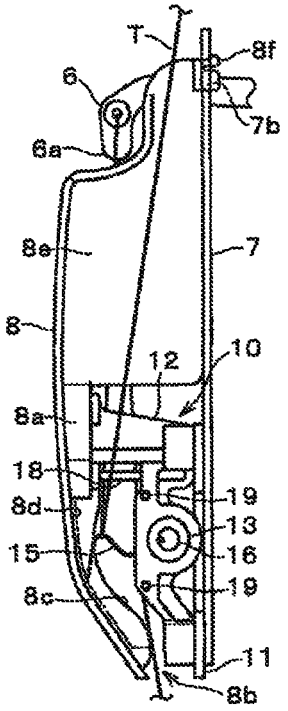
FIG. 3 is a schematic right side view of a front cover plate shown in FIG. 1.
Figure 4:
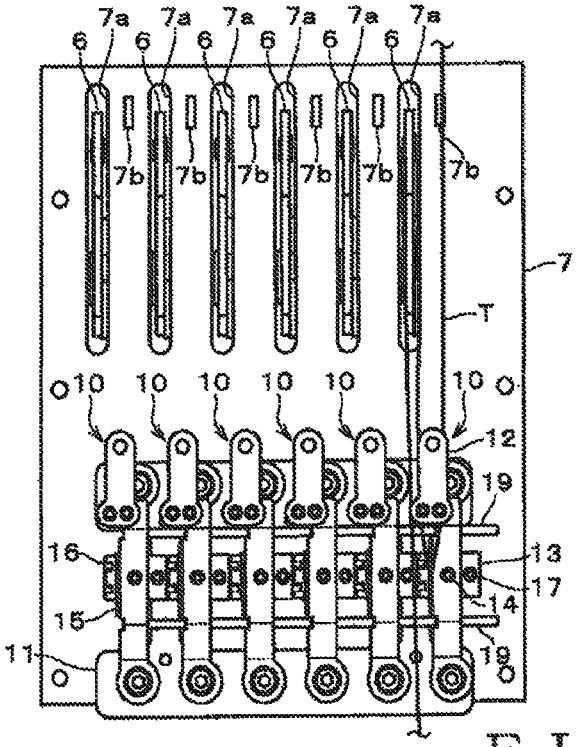
FIG. 4 is a schematic front view showing a plurality of thread take-up levers and a plurality of thread take-up members in the machine head with all of the cover members removed therefrom.

Cover members 8 are provided on the front surface of the front cover plate 7 in association with, or in corresponding relation to, the thread take-up levers 6, and outer side cover members 9 are fixed outside of the leftmost and rightmost cover members 8. FIG. 3 is a schematic right side view of the front cover plate 7 with the outer side cover members 9 removed therefrom for clarity, which corresponds to a view showing one of the cover members 8 from its right side. FIG. 4 is a schematic front view of the front cover plate 7 with the cover members 8 and outer side cover members 9 removed therefrom; namely, FIG. 4 schematically shows, from the front of the machine head H, the plurality of thread take-up levers 6 and thread take-up members 10 provided in one machine head H with all of the cover members 8 and outer side cover members 9 removed therefrom. As apparent from these figures, the take-up members 10 are provided on a lower portion of the front surface of the cover plate 7 in corresponding relation to the thread take-up levers 6.

Figure 5:
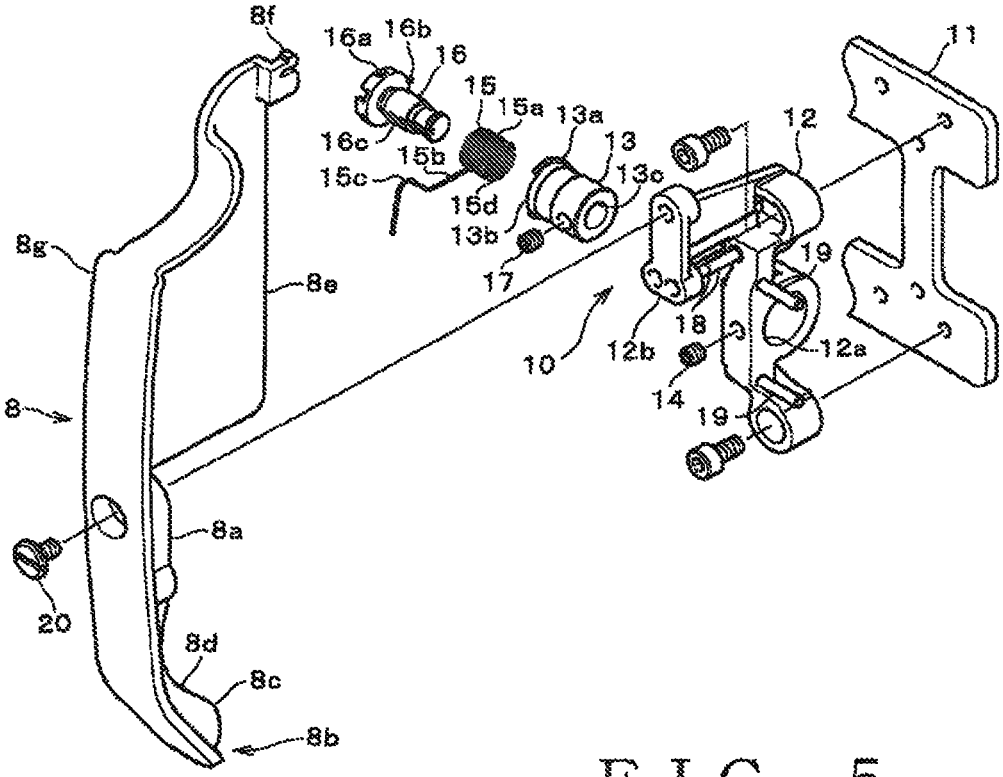
FIG. 5 is an exploded perspective view of one of the thread take-up members.

FIG. 5 is an exploded perspective view of one of the thread take-up members 10. The thread take-up lever 10 has a holding member 12 fixed to a base member 11 that is in turn fixed to a lower portion of the front surface of the front cover plate 7. The holding member 12 has a mounting hole 12*a* formed laterally through a substantial central portion thereof. A cylindrical case 13 is inserted in the mounting hole 12*a* and fixed by means of a mounting screw 14 with a flange portion 13*a*, formed on a left end portion of the cylindrical case 13, abutted against the left side surface of the holding member 12. A thread take-up spring 15 and a spring shaft 16 are mounted to the cylindrical case 13.

Figure 6:
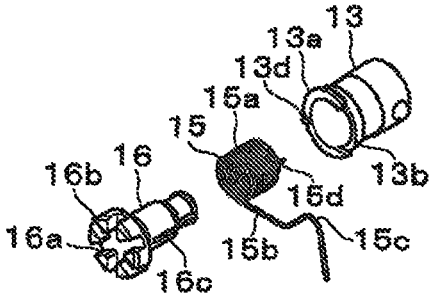
FIG. 6 is an exploded perspective view showing, in a different direction, a cylindrical case, thread take-up spring and spring shaft in the thread take-up member of FIG. 5.

FIG. 6 is an exploded perspective view showing the cylindrical case 13, thread take-up spring 15 and spring shaft 16 in a different direction from FIG. 5. The thread take-up spring 15 includes a coil section 15*a* formed of a spring wire wound in a coil shape, a lever section 15*b* formed integrally with and extending continuously from one end of the coil section 15*a* in a radial outward direction, a hook section 15*c* formed integrally with and extending continuously from the distal end of the lever section 15*b*, and a locking section 15*d* formed integrally with and extending continuously from the other end of the coil section 15. A biasing force of the spring acts on the lever section 15*b* of the thread take-up spring 15 in a downward direction in the illustrated example. The spring shaft 16 includes a head section and a shaft section, and the head section has a plurality of operating grooves 16*a* formed therein to extend in a radial direction thereof, and a restricting portion 16*b* formed thereon. The shaft section of the spring shaft 16 has an engaging groove 16*c* formed therein for engagement with the locking section 15*d* of the thread take-up spring 15. Further, the shaft section of the spring shaft 16 has a distal end portion of a reduced diameter, and the distal end portion is fittable in a fitting hole 13*c* of the cylindrical case 13 for rotation about the axis thereof. More specifically, the shaft section of the spring shaft 16 is fitted in the cylindrical case 13 with the coil section 15*a* of the thread take-up spring 15 mounted around the outer periphery of the shaft section of the thread take-up spring 15 and with the locking section 15*d* of the thread take-up spring 15 engaged in the engaging grooves 16*c* of the spring shaft 16. Further, the cylindrical case 13 has a recess 13*b* formed by recessing the flange portion 13*a* over a predetermined angular range of the flange portion 13*a*, and the lever section 15*b* of the thread take-up spring 15 is positioned in the recess 13*b*. Then, the spring shaft 16 is turned about its central axis so that the lever section 15*b* of the thread take-up spring 15 is abutted against the lower end of the recess 13*b*, and the spring shaft 16 is fixed to the cylindrical case 13 by means of a mounting screw (fastening member) 17 at a rotational position thereof where the thread take-up spring 15 can exert an intended biasing force (i.e., spring resilience). The flange portion 13*a* of the cylindrical case 13 has a locking portion 13*d* provided thereon that abuts against the restricting portion 16*b* of the spring shaft 16 to prevent the spring shaft 16 from rotating more than one rotation. This is because the thread take-up spring 15 may break if the spring shaft 16 rotates more than one rotation.

Two rollers 18 spaced apart from each other by a predetermined distance are provided on the holding member 12 above the hook section 15*c* of the thread take-up spring 15 in such a manner that the two rollers 18 are located to the left and right, respectively, of the hook section 15*c*. Further, two pins (prevention members) 19 are fixed to the right side surface of the holding member 12 for preventing an upper thread, hooked on the hook section 15*c* of the thread take-up spring 15, from undesirably flowing rearward. As seen from FIG. 4, the distal ends of the pins 19 are located and supported in a recessed portion formed in the left side surface of another (i.e., right neighboring) holding member 12 that is located immediately to the right of the holding member 12 in question. Thus, the pins 19 extend horizontally between the adjoining holding members 12. Although not particularly shown, two pins 19 are fixed to the left outer side cover member 9, and the distal ends of these two pins 19 are located in a recessed portion formed in the left side surface of the leftmost holding member 12. With the pins 19 provided in the aforementioned manner, each of the upper threads hooked on the hook portions 15*c* can be reliably prevented from undesirably flowing rearward. Namely, the pins 19 functions as prevention member for preventing the thread, put hooked on the thread take-up spring 15, from flowing rearward. Note that the number of the pins 19 provided in association with each one of the thread take-up springs 15 is not limited to just two and may be one or three or more.

Each of the cover members 18 is fixedly mounted to the front surface of the holding member 12 by means of a mounting screw 20 and can be independently dismounted or detached in the forward direction by removal of the mounting screw 20. The cover member 8 has a seat 8*a* formed on its reverse or back surface, and the seat 8*a* has a recess (i.e., fitting structure not shown) for fitting therein a mounting portion 12*b* formed on the holding member 12. Further, a lower end portion 8*b* of the cover member 8 is formed as an open end portion so as to provide an open space between the cover member 8 and the holding member 12. This open space serves as an inserting gap through which an upper thread can be inserted from below the cover member 8. Further, because each one of the cover members 8 is independent from the other cover members 8, gaps are also formed in succession between the one cover member 8 and the left and right neighboring cover members 8 located to the left and right of the one cover member 8, so that the upper thread T inserted through the open space of the lower end portion 8*b* of the one cover member 8 can be passed through the gaps formed in the left and right side surfaces of the one cover member 8, i.e. between one cover member 8 and the left and right neighboring cover members 8.

Further, a guide wall 8*c* is formed on the reverse or back surface of the cover members 18, and the guide wall 8*c* extends from the lower end portion 8*b* to the seat 8*a* for guiding the upper thread, inserted through the open space of the lower end portion 8*b*, to the hook section 15*c* of the thread take-up spring 15. Namely, an upper edge portion of the guide wall 8*c* has an outline adapted to guide the thread from the lower end portion 8*b* of the cover member 8 to the thread take-up spring 15. The guide wall 8*c* has a valley portion 8*d* for permitting entry therein a distal end portion of the hook section 15*c* over a moving range of the hook section 15*c* of the thread take-up spring 15. Thus, the guide wall 8*c* functions also as a guide section having the valley portion 8*d* for receiving the distal end portion of the hook section 15*c* to movably guide the distal end portion of the hook section 15*c*. Namely, in the instant embodiment (first embodiment) of the invention, the guide wall 8*c* functions not only as a guide section for movably guiding the distal end portion of the hook section 15*c* by means of the valley portion 8*d* formed therein, but also as a guide section adapted to guide the thread from the lower end portion 8*b* of the cover member 8 to the thread take-up spring 15 by means of the outline of its upper edge portion. The cover member 8 also has a shield plate portion 8*e* formed on an upper portion thereof for shielding the right side of a distal end portion of the thread take-up lever 6 in a predetermined range of a vertical pivoting path of the thread take-up lever 6. Further, an engaging section 8*f* having a claw portion for engagement with a through hole (fixing portion) 7*b* of a rectangular shape formed in the front cover plate 7 is provided on an upper rear end portion of the cover member 8. In mounting of the cover member 8, the cover member 8 can be held in a vertical posture (i.e. the cover member 8 can be positioned at a predetermined location) by engagement of the engaging section 8*f* with the through-hole 7*b* and fitting of the mounting portion 12*b* of the holding member 12 in the recess of the seat 8*a*.

As clear from FIG. 3, a portion of the cover member 8 where a distal end portion of the thread take-up lever 6 at its top dead point is located has a deeply hollowed shape such that the cover member 8 does not hamper human operator's fingers pinching a thread when the human operator passes the thread through a through-hole of the thread take-up lever 6. The thread take-up lever 6 has a downwardly-extending distal end portion 6*a* to prevent the human operator's fingers from entering between the deeply hollowed shape and the distal end of the thread take-up lever 6.

During a sewing operation, as known in the art, the thread take-up lever 6 vertically pivots between a predetermined top dead point and a predetermined bottom dead point, and thus the thread take-up lever 6 moves downward to a position lower than shown in FIG. 3. As shown in FIG. 5, a thread-take-up-lever cover section 8*g* is formed on the front surface of the cover member 8, and this thread-take-up-lever cover section 8*g* functions to cover the distal end portion of the thread take-up lever 6 in the predetermined range of the vertical pivoting path of the thread take-up lever 6. This arrangement can eliminate a possibility of the human operator accidentally or carelessly touching the thread take-up lever 6 during the sewing operation. Here, the thread-take-up-lever cover section 8*g* extends in a predetermined range such that it does not cover the corresponding thread take-up lever 6 when the thread take-up lever 6 is located at the top dead point so that the thread take-up lever 6 located at the top dead point is exposed from the thread-take-up-lever cover section 8*g* but it covers the thread take-up lever 6 when the thread take-up lever 6 is located lower than the top dead point. In this way, when the thread take-up lever 6 is located at the top dead point, the human operator can access the thread-take-up-lever cover section 8*g* without removing or detaching the cover member 8, so that the human operator can perform a threading operation on the thread take-up lever 6 with ease.

The following describe a manner in which an upper thread T is set in the instant embodiment. As shown in FIGS. 1, 3 and 4, an upper thread T having been directed from above the needle bar case 2 in association with any one of the needle bars is passed through the gap between the corresponding cover member 8 and the right neighboring cover member 8, located immediately to the right of that cover member 8, or the outer side cover member 9, then directed to the lower end portion 8*b* of the cover member 8 to be hooked across the lower end portion 8*b*, and then turned back upward. After that, the upper thread T is pulled up while being passed through the gap between the corresponding cover member 8 and the left neighboring cover member 8, located immediately to the left of that cover member 8, or the outer side cover member 9. In this manner, the upper thread T is inserted through the inserting gap of the lower end portion 8*b* of the cover member 8, guided along the guide wall 8*c* and then hooked on the hook section 15*c* of the thread take-up spring 15. After that, the upper thread T is passed through the through-hole of the thread take-up lever 6 to be turned back downward, then again passed through the gap between the corresponding cover member 8 and the left neighboring cover member 8 located immediately to the left of that cover member 8 or the outer side cover member 9, and then passed through a lower thread path 21 disposed under the needle bar case 2. After that, the upper thread T is threaded through the corresponding sewing needle 5. Namely, the upper thread T can be easily hooked on the hook portion 15*c* of the thread take-up spring 15 by the upper thread T being merely hooked across the lower end portion of the cover member 8, turned back and then pulled upward.

During such a setting operation of the upper thread T and during a sewing operation as well, the upper thread T hooked on the hook portion 15*c* of the thread take-up spring 15 is guided by the rollers 18 disposed above the hook portion 15*c* upstream and downstream of the hook portion 15*c*, and thus, the upper thread T can flow smoothly.

Although the upper thread T may slack in the neighborhood of the hook portion 15*c* of the thread take-up spring 15 during an embroidery sewing operation, it can be prevented from coming off the hook portion 15*c* because the distal end of the hook portion 15*c* is inserted in the valley portion 8*d* of the cover member 8. Further, because the slackened upper thread T is stopped by the two pins 19, it can be prevented from flowing rearward to get caught by any of other component parts, such as the cylindrical case 13 and spring shaft 16.

The following describe a manner in which maintenance operation is performed on the thread take-up member 10 in the instant embodiment. Namely, when maintenance operation is to be performed, the mounting screw 20 fastening or fixing the cover member 8 of the thread take-up member 10 is removed to dismount or detach the cover member 8 from the holding member 12. At that time, the cover member 8 can be detached with the upper thread T left set on the thread take-up member 10.

When the spring resilience of the thread take-up spring 15 is to be changed in the thread take-up member 10, the mounting screw 17 fastening the spring shaft 16 is loosened, and an operating tool of, for example, a rod shape is inserted into the operating groove 16*a* of the head section of the spring shaft 16 to turn the spring shaft 16 by operation of the operating tool. In this manner, the locking section 15*d* of the thread take-up spring 15 changes in position to cause the spring resilience of the thread take-up spring 15 to change. Then, once an intended spring resilience of the thread take-up spring 15 is reached, the human operator tightens the mounting screw (fastening member) 17 to fasten or fix the spring shaft 16.

In the instant embodiment, as set forth above, the upper thread T can be easily hooked on the hook portion 15*c* of the thread take-up spring 15 by the upper thread T being merely hooked across the lower end portion of the cover member 8, turned back and then pulled upward.

Further, when maintenance is to be performed on the thread take-up member 10 corresponding to the one thread take-up lever 6, it is only necessary to detach the corresponding cover member 8, and thus, operations involved in the maintenance of the thread take-up member can be highly facilitated.

Further, when the spring resilience of the thread take-up spring 15 is to be changed, it is only necessary to loosen the mounting screw 17 and then turn the spring shaft 16, and thus, the operation for changing the spring resilience can also be highly facilitated.

Whereas the first embodiment has been described above in relation to the case where the shield plate portion 8*e* is provided on the cover member 8 for shielding the right side of the distal end portion of the thread take-up lever 6, such a shield plate portion 8*e* is not necessarily essential because the distal end portion of the thread take-up lever 6 is covered with the thread-take-up-lever cover section 8*g* formed on the front surface of the cover member 8.

Further, whereas the first embodiment has been described above in relation to the case where the holding member 12 is fixed to the base member 11 that is in turn fixed to the lower portion of the front surface of the front cover plate 7, the holding member 12 may be fixed directly to the front cover plate 7.

Figure 7:
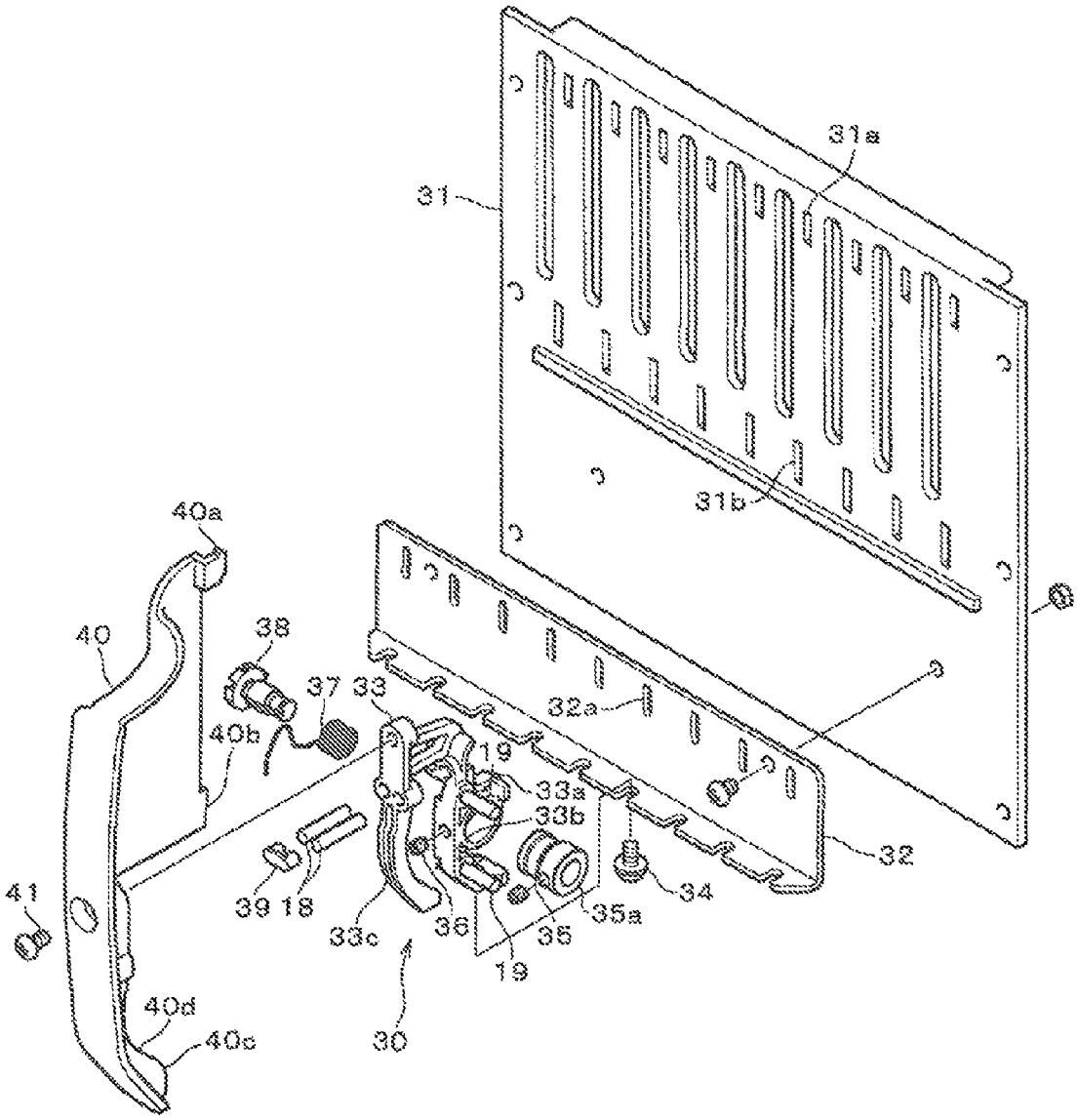
FIG. 7 is an exploded perspective view showing another embodiment of the embroidery sewing machine of the present invention and particularly another embodiment of the thread take-up lever.

Next, a description will be given about another (second) embodiment of the sewing machine, and more particularly another embodiment of the thread take-up member with reference to FIG. 7. In FIG. 7, a front cover plate 31, which corresponds to the front cover plate 7 shown in FIGS. 1, 2 etc., is a support member cover fixed to the front surface of the needle bar case (support member) 2. A base member 32, which corresponds to the base member 11 shown in FIGS. 3, 4 etc., is fixed to a lower portion of the front surface of the front cover plate 31.

In FIG. 7, similarly to the thread take-up members 10, a plurality of the thread take-up members 30 are provided on the front surface of the front cover plate 31, in corresponding relation to the individual thread take-up levers 6. Similarly to the thread take-up members 10, the thread take-up members 30 each include a thread take-up spring 37 and a holding member 33. The holding member 33, which corresponds to the above-described holding member 12, is fixed to the base member 32. An engaging section 33*a* for engagement with one of elongated through-holes 32*a* formed in the base member 32 is formed on a substantial central portion of the back surface. By the engagement of the engaging section 33*a* with the elongated through-hole 32*a*, the holding member 33 is positioned at a predetermined position and fastened to the base member 32 by means of a mounting screw 34.

The holding member 33 has a mounting hole 33*b* formed laterally through a substantial central portion thereof. A cylindrical case 35 is inserted in the mounting hole 33*b* and fixed to the holding member 33 by means of a mounting screw 36 with a collar portion 35*a*, formed on a right end portion of the cylindrical case 35, abutted against the right side surface of the holding member 33. A thread take-up spring 37 and a spring shaft 38 are mounted to the cylindrical case 35. Constructions of other portions than the collar portion 35*a* and the thread take-up spring 37 and spring shaft 38 are similar to the corresponding portions and members provided in the above-described embodiment (first embodiment) and thus will not be described in detail here to avoid unnecessary duplication.

Two rollers 18 spaced apart from each other by a predetermined distance in the left-right direction of the holding member 33 are provided on the holding member 33 above the thread take-up spring 37, as in the first embodiment. In the instant embodiment (second embodiment), a grommet 39 is provided for preventing coming off of the rollers 18. As in the above-described first embodiment, two pins (prevention members) 19 are fixed to the right side surface of the holding member 33. A guide section 33*c* having a groove or slit for receiving a distal end portion of the thread take-up spring 37 to movably guide the distal end portion of the thread take-up spring 37 is provided on a lower front portion of the holding member 33. Namely, the guide section 33*c* has left and right walls defining the groove or slit for receiving a distal end portion of the thread take-up spring 37 to movably guide the distal end portion of the thread take-up spring 37.

A cover member 40 similar to the cover member 8 provided in the above-described first embodiment is fastened to the front surface of the holding member 33 by means of a mounting screw 41. Note, however, that the cover member 40 in the second embodiment has not only an engaging section (first engaging section) 40*a*, similar to the engaging section 8*f* in the first embodiment, having a claw portion formed on an upper rear end portion thereof but also a second engaging section 40*b* formed beneath the first engaging section 40*a*. The front cover plate 31 has a first through-hole 31*a* of a rectangular shape for engagement with the first engaging section 40*a*, and a second through-hole 31*b* of a rectangular shape for engagement with the second engaging section 40*b*. In mounting of the cover member 40, the cover member 40 can be held in a vertical posture more accurately by engagement of the first engaging section 40*a* with the first through-hole 31*a* and engagement of the second engaging section 40*b* with the second through-hole 31*b*.

The cover member 40 is substantially similar to the cover member 8 provided in the first embodiment, except that the cover member 40 has the second engaging section 40*b*. The cover member 40 includes a guide wall 40*c* (corresponding to the guide wall 8*c* in the first embodiment), and a valley portion 40*d* formed in the guide wall 40*c* (corresponding to the valley portion 8*d* in the first embodiment). In the second embodiment, however, the valley portion 40*d* formed in the guide wall 40*c* has a greater width than the valley portion 8*d* and is constructed to receive therein the guide section 33*c* of the holding member 33 rather than directly receiving a distal end portion of the thread take-up spring 37. Namely, the guide section 33*c* of the holding member 33 is detachably fittable in the valley portion 40*d* formed in the guide wall 40*c*. Because the holding member 33 is fixed to the front cover plate 31, the guide section 33*c* is left on the front cover plate 31 with the cover member 40 detached, while the guide section 33*c* of the holding member 33 is fitted in the valley portion 40*d* of the guide wall 40*c* with the cover member 40 attached. A distal end portion of the thread take-up spring 37 is received in and movably guided by the groove or slit of the guide section 33*c* that is fitted in the valley portion 40*d* of the cover member 40 with the cover member 40 attached. The holding member 33 (and particularly the guide section 33*c*) is formed of metal, and thus, a side surface of the guide section 33*c* would not be bruised even when the distal end portion of the thread take-up spring 37 slidingly moves on the side surface of the guide section 33*c*.

By contrast, in the above-described embodiment, the distal end portion of the thread take-up spring 15 is guided directly by the valley portion 8*d* of the cover member 8. Because the cover member 8 is formed of resin, a side surface of the valley portion 8*d* would be bruised as the distal end portion of the thread take-up spring 15 slidingly moves on the surface, and such bruises can hamper the movement of the thread take-up spring 15. However, the second embodiment can eliminate such an inconvenience. Further, the guide section 33*c* on the holding member 33 can protect the distal end portion of the thread take-up lever 37 even with the cover member 40 detached, so that the thread take-up lever 37 can be prevented from being undesirably bent, for example, when the human operator touches the thread take-up lever 37.

As a modification of the above-described second embodiment, the valley portion 40*d* of the cover member 40 may be dispensed with. In such a case, only an upper portion (where the mounting screw 41 is inserted) of the holding member 33 may be fitted in the cover member 40 without a lower portion (where the guide section 33*c* is provided) of the holding member 33 being fitted in the cover member 40. Even in this case, the thread set on the thread take-up spring 37 would not come off the thread take-up spring 37 even when the thread slacks to some degree, because the distal end portion of the thread take-up spring 37 is received in the groove or slit formed in the guide section 33*c* of the holding member 33.

Further, where the guide section 33*c* of the holding member 33 is shaped into an outline adapted to guide the thread from the lower end portion of the cover member 40 to the thread take-up spring 37, the guide wall 40*c* of the cover member 40 may be simplified or dispensed with. In the case where the guide wall 40*c* of the cover member 40 is to be simplified, the guide wall 40*c* may be constructed to perform its guide function only in the neighborhood of a lower end portion of the cover member 40, and in an area above the neighborhood of the lower end portion of the cover member 40, upper edge portions of left and right guide walls of the guide section 33*c* (i.e., portions located inward of a curved region of the guide section 33*c*) may take charge of part of the guide function. Even where the guide wall 40*c* is simplified or dispensed with like this, the upper edge portions of left and right guide walls of the guide section 33*c* (i.e., portions located inward of the curved region of the guide section 33*c*) can function as a guide member similar to the guide wall 40*c*, i.e. as the guide member for guiding the thread from the lower end portion of the cover member 40 to the thread take-up spring 37.

Finally, it should be appreciated that the present invention is applicable not only to embroidery sewing machines but also to other types of sewing machines.

What is claimed is:

1. A sewing machine comprising: a support member; one or more needle bars each vertically movably supported by the support member and having a sewing needle attached to a lower end thereof; one or more thread take-up levers vertically pivotably supported by the support member in association with individual ones of the needle bars; a support member cover disposed on a front surface of the support member and constructed to permit insertion therethrough of the one or more thread take-up levers, said sewing machine further comprising, in association with each of the thread take-up levers:

a thread take-up member disposed on a front surface of the support member cover and having a thread take-up spring;

a prevention member for preventing a thread, put on the thread take-up spring, from flowing rearward;

a cover member provided in front of the thread take-up member in such a manner that said cover member is independently detachable in a forward direction, the cover member having a lower end portion opened to permit insertion therein of a thread, the cover member being constructed to guide the thread from the lower end portion to said thread take-up spring; and a guide section having a valley portion formed therein for receiving therein a distal end portion of said thread take-up spring and movably guiding the received distal end portion.

2. The sewing machine as claimed in claim 1, wherein said cover member further has a guide wall adapted to guide the thread from the lower end portion to said thread take-up spring.

3. The sewing machine as claimed in claim 1, wherein the guide section having the valley portion formed therein is provided on said cover member.

4. The sewing machine as claimed in claim 1, wherein the guide section having the valley portion formed therein is provided on said thread take-up member.

5. The sewing machine as claimed in claim 4, wherein the guide section having the valley portion formed therein is formed of a different material from said cover member.

6. The sewing machine as claimed in claim 1, wherein said guide section further has an outline adapted to guide a thread from the lower end portion of said cover member to said thread take-up spring.

7. The sewing machine as claimed in claim 1, wherein said cover member comprises a thread take-up lever cover section covering a distal end portion of the thread take-up lever in a predetermined range of a vertical pivoting path of the thread take-up lever.

8. The sewing machine as claimed in claim 7, wherein, when said thread take-up lever corresponding to said cover member is at an upper dead point thereof, said thread take-up lever is exposed from the thread take-up lever cover portion and accessible without said cover member being detached.

9. The sewing machine as claimed in claim 8, wherein said thread take-up lever has a distal end portion extending beneath a threading hole of said thread take-up lever.

10. The sewing machine as claimed in claim 1, wherein said cover member is detachably mounted by means of a screw.

11. The sewing machine as claimed in claim 1, wherein said cover member has an engaging section and is detachably mounted to a predetermined fixing portion via the engaging section.

12. The sewing machine as claimed in claim 11, wherein said cover member includes a fitting structure provided on a back surface thereof for fitting engagement with a mounting portion formed on a predetermined part of said thread take-up member, so that said cover member is positioned by engagement via the engaging section and the fitting engagement via the fitting structure.

13. The sewing machine as claimed in claim 1, wherein said thread take-up spring comprises:

a coil section formed of a spring wire wound in a coil shape;

a lever section formed integrally with and extending continuously from one end of the coil section in a radial outward direction;

a thread-engaging hook section formed integrally with a distal end of the lever section; and a locking section formed integrally with another end of the coil section, wherein said thread take-up member comprises:

a holding member having a mounting hole;

a cylindrical case fixed to the mounting hole of the holding member; and a spring shaft rotatably fitted within the cylindrical case, the spring shaft having an engaging groove for engagement with the locking section of said thread take-up spring, wherein said thread take-up spring is mounted on the spring shaft by the locking section of said thread take-up spring being engaged with the engaging groove with the coil section of said thread take-up spring mounted around an outer periphery of the spring shaft, and wherein the cylindrical case has a recess formed therein by being recessed over a predetermined angular range thereof, the spring shaft being fixed to the cylindrical case via a fastening member with the lever section of said thread take-up spring positioned in the recess and abutted against a lower end of the recess.

14. The sewing machine as claimed in claim 1, wherein said thread take-up member comprises said thread take-up spring and a holding member for holding said thread take-up spring, and the holding member is fixed to the front surface of the support member cover.

15. The sewing machine as claimed in claim 1, wherein said prevention member comprises at least one pin fixed in such a manner as to block the thread from flowing rearward.

* * * * *